US006500060B2

(12) United States Patent
Hanosh

(10) Patent No.: US 6,500,060 B2
(45) Date of Patent: Dec. 31, 2002

(54) ROTARY POLISHING DISCS AND ARBORS THEREFOR

(76) Inventor: Alan L. Hanosh, 5793 Acorn Ridge Dr., Paradise, CA (US) 94969

( * ) Notice: Subject to any disclaimer, the term of this patent is extended or adjusted under 35 U.S.C. 154(b) by 0 days.

(21) Appl. No.: 09/898,329

(22) Filed: Jul. 3, 2001

(65) Prior Publication Data

US 2001/0039174 A1 Nov. 8, 2001

Related U.S. Application Data

(62) Division of application No. 09/238,869, filed on Jan. 27, 1999, now Pat. No. 6,322,435.

(60) Provisional application No. 60/073,304, filed on Jan. 28, 1998.

(51) Int. Cl.[7] ..... B24D 17/00

(52) U.S. Cl. ..... 451/496; 451/502; 451/512

(58) Field of Search ..... 451/490, 502, 451/503, 504, 508, 509, 510, 512, 511, 496, 497

(56) References Cited

U.S. PATENT DOCUMENTS

| | | | | | |
|---|---|---|---|---|---|
| 881,691 | A | * | 3/1908 | Hughes | 451/508 |
| 3,014,795 | A | | 12/1961 | Schmidlin | |
| 3,046,709 | A | * | 7/1962 | Cook | 451/510 |
| 3,526,065 | A | | 9/1970 | Lee | |
| 3,653,858 | A | * | 4/1972 | Field | 451/510 |
| 3,683,567 | A | | 8/1972 | Ali | |
| 3,800,483 | A | * | 4/1974 | Sherman | 451/508 |
| 3,858,368 | A | | 1/1975 | Cocherell et al. | |
| 3,883,998 | A | * | 5/1975 | Dosser | 451/508 |
| 4,185,388 | A | | 1/1980 | Jarby | |
| 4,447,208 | A | | 5/1984 | Kawai | |
| 4,554,765 | A | | 11/1985 | Grimes et al. | |
| 4,653,236 | A | | 3/1987 | Grimes et al. | |
| 4,674,234 | A | | 6/1987 | Reiling et al. | |
| 4,839,998 | A | | 6/1989 | Block | |
| 5,756,168 | A | | 5/1998 | Maag | |
| 5,865,571 | A | | 2/1999 | Tankala et al. | |

* cited by examiner

*Primary Examiner*—Timothy V. Eley
(74) *Attorney, Agent, or Firm*—D. E. Schreiber

(57) ABSTRACT

A rotary polishing disc for dental grinding and polishing includes a disc-shaped piece of sheet of abrasive material fixed to a hub. In one embodiment, the hub is a hollow cylinder which is received onto a rotatable arbor. In another embodiment, the hub has a first end fixed to the sheet material, and has a second end that is received by a socketed end of the arbor. To fix the disc-shaped piece of sheet material more securely to the hub, a retainer plug may pass through a central aperture in the sheet material and enter into the hub. The retainer plug has a flat cap which becomes juxtaposed with the sheet material furthest from the hub. In another aspect, an improved arbor for the first type of hub includes protruding barbs which spear the hub when its hollow interior is disposed on the arbor.

9 Claims, 4 Drawing Sheets

ROTARY POLISHING DISCS AND ARBORS THEREFOR

CLAIM OF PROVISIONAL APPLICATION RIGHTS

This is a division of application Ser. No. 09/238,869 filed Jan. 27, 1999 now U.S. Pat. No. 6,322,435, which claims the benefit of U.S. Provisional Patent Application No. 60/073,304, filed on Jan. 28, 1998.

BACKGROUND OF THE INVENTION

1. Field of the Invention

The present invention relates to improvements in polishing discs and the method of making them, and in particular to a polishing disc cut from sheet abrasive material and adhered to an inexpensively produced plastic hub that locks onto a rotatable arbor.

2. Description of the Prior Art

In the field of dentistry it is necessary to contour, finish and polish restorative dental materials once they have been placed into or onto a tooth so that the restorative materials blend to the contour of the tooth with a smooth transition between the material and tooth structure. It is imperative that the restorative materials be highly polished to prevent plaque build up which leads to other complications.

The most common dental restorative materials currently used are composite, amalgam, gold, ceramics, acrylic, and glassionomers. These as well as other polishable materials usually require polishing with a minimum of at least two steps of sequential grits, with most materials requiring three to six steps before achieving satisfactory results. This series of polishings usually requires single-use, disposable discs having a sequence of grit sizes. For this reason, not only must dental polishing discs be inexpensive in terms of material and manufacturability, but to save dentists' time they must also be capable of being very quickly secured to and removed from a driving arbor. Because the dental polishing discs is used inside a patient's mouth, it must be relatively small, and be rigidly secured to the arbor so it won't wobble or fly off.

Several prior art devices are available for this purpose. Generally they are comprised of grit coated thin discs of paper or plastic or thin rigid discs of abrasive, having a central aperture to receive a screw, pin, shaft or the like, by means of which the disc can be secured to a rotary drive shaft or arbor. With most prior art, the head of the shaft or arbor protrudes from the forward face of the dental polishing disc and clamps to the inner area of the disc by means of a metal or plastic eyelet that may be swaged through the disc. The protrusion of the shaft or arbor beyond the dental polishing disc limits the working area of the disc, and during polishing can inadvertently cause damage to the restorative material, tooth structure, or tissue.

U.S. Pat. Nos. 3,858,368 and 4,447,208 disclose a dental polishing disc in which the central hub or the entire polishing head is made of soft rubber. The central hub of such dental polishing discs are formed with a blind, hollow, cylindrically-shaped interior cavity having at least one flattened surface so a head portion of the arbor may be inserted into the cavity thus securing the disc to the arbor. The central hubs of these molded dental polishing discs can either be molded integrally with the polishing disc or molded separately and attached to the disc by means of an adhesive material. Because these dental polishing discs have a blind interior cavity the arbor cannot protrude beyond the dental polishing disc. Thus, dental polishing discs having molded rubber hubs prevent inadvertently damaging restorative material, tooth structure, or tissue. However, the molded central hub or entire polishing head is comparatively expensive, bulky, and can be manufactured only in a limited range of shapes and sizes. Using a blind hole configuration as in these devices, there always exists a rubber filled space between the disc and the arbor which remains flexible thus permitting the dental polishing disc to wobble on the arbor. Furthermore, due to poor engagement between the molded rubber hub and the arbor such dental polishing discs tend to fly off the arbor when polishing with the surface of the disc adjacent to the arbor.

BRIEF SUMMARY OF THE INVENTION

A primary object of the present invention is to provide a rotary polishing disc and hub which is inexpensive and easy to manufacture.

Another object of the present invention is to provide a polishing disc and hub which attach quickly, easily, and removably to the arbor with a rigid secure fit without wobble and without the danger of falling off.

A related object of the present invention is to form the hub using an inexpensive plastic extrusion.

Another object of the preferred embodiment of the present invention is provide a hub having an interior surface along the entire length of which matches the cross-sectional shape of the arbor insertable thereinto thus providing a tight friction fit to retain the polishing head securely on the arbor free from wobbling.

Another corollary object of the preferred embodiment of the present invention is to prevent the polishing head from flying off of the arbor.

A related object of an alternate embodiment of the present invention is to provide a hub having several flexible arms which engage an interior surface of a mating, hollow arbor.

Another object of the present invention is to adhere the hub to the back face of the abrasive polishing disc so the entire front abrasive surface of the polishing disc is usable for polishing.

One more object of the present invention is to improve engagement between the hub and larger diameter or high-friction dental polishing discs cut from sheet abrasive material.

Briefly, in one aspect the present invention is a rotary polishing disc adapted for attachment to an end of a rotatable arbor. The rotary polishing disc includes a disc-shaped piece of sheet material having an abrasive material on at least one surface thereof. The rotary polishing disc also includes a hub that is juxtaposed with and fixed to the disc-shaped piece of sheet material. The hub has a longitudinal axis that is oriented substantially perpendicular to a surface of the disc-shaped piece of sheet material with which the hub is juxtaposed.

In one embodiment of this aspect of the present invention the hub is cylindrically-shaped with the longitudinal axis extending through a hollow interior of the hub. The hollow interior of this hub is formed with a cross-sectional shape that is adapted to mate with and to receive a projecting end of the rotatable arbor completely thereinto so the projecting end becomes juxtaposed with the disc-shaped piece of sheet material.

In another embodiment of this aspect of the present invention, the hub is elongated with a first end that is juxtaposed with and fixed to the surface of the disc-shaped piece of sheet material. This second embodiment of the hub also has a second end that projects away from the disc-shaped piece of sheet material. The second end of this hub is pierced by a slot to establish at least one flexible arm that has an outwardly projecting tip at the end thereof furthest from the disc-shaped piece of sheet material. For this second embodiment of the hub, the flexible arm and tip are shaped to enter into, mate with and engage an interior surface of a socketed end of the rotatable arbor.

To fix the disc-shaped piece of sheet material more securely to the hub, the disc-shaped piece of sheet material of either of the preceding embodiments may be pierced by a central aperture through which passes a retainer plug. The retainer plug has a flat cap formed at an end thereof which is juxtaposed with a surface of the disc-shaped piece of sheet material furthest from the hub. For the first embodiment of the hub described above, a second end of the retainer plug, furthest from the flat cap, enters into and becomes frictionally engaged with the hollow interior of the hub. For the second embodiment of the hub described above, the second end of the retainer plug enters into and becomes frictionally engaged with a cavity formed into the first end of the hub adjacent to the central aperture.

In another aspect, the present invention includes a improved arbor which, in a first configuration, has a projecting end that is adapted to receive and mate with a hollow interior surface of a hub of a rotary polishing disc. This first improved arbor configuration includes a barb protruding from an exterior surface of the arbor that is adapted to spear the hub when the hollow interior of the hub is disposed on the arbor. A second improved arbor configuration includes a hollow socket formed at one end of the arbor. The hollow socket has an interior surface which is shaped to receive and to mate with the flexible arm and tip at one end of an elongated hub.

An advantage of the present invention is simpler manufacturing and lower manufacturing cost for enhanced performance dental polishing discs.

The intended use for the present invention is dental grinding and polishing discs. Accordingly, the present invention will be specifically described with reference to that field by way of illustration. However, the present invention is not limited to use in that field, and appears useful in other applications that require a small rotary polishing disc. These and other features, objects and advantages will be understood or apparent to those of ordinary skill in the art from the following detailed description of the preferred embodiment as illustrated in the various drawing figures.

DETAILED DESCRIPTION

Figure 1A:
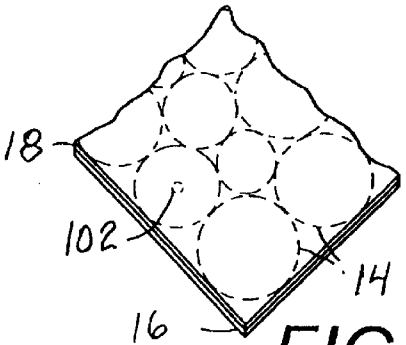
FIG. 1A is a partial perspective view illustrating how disc-shaped pieces depicted in FIG. 1 are cut, stamped or punched from a thin flexible sheet of material having an abrasive coating on one or both sides.
Figure 1B:
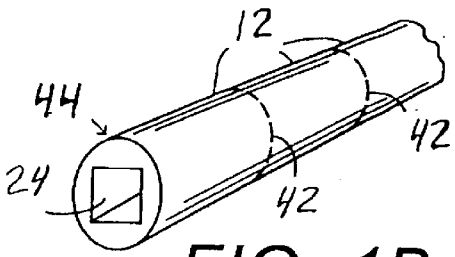
FIG. 1B is a partial perspective view illustrating how hubs of the embodiment depicted FIG. 1 are cut from an extruded tube.
Figure 1:
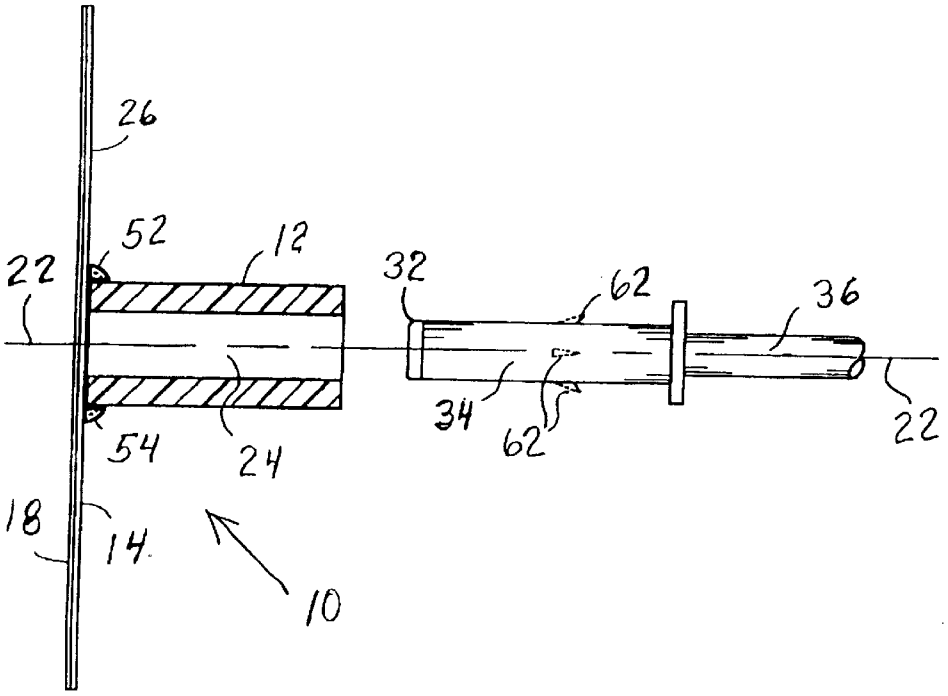
FIG. 1 is a partially-sectioned elevational view showing one embodiment of a rotary polishing disc having a disc-shaped piece of sheet material fixed to an extruded hub that is aligned for interconnection with a mating arbor which may include projecting barbs.

FIG. 1 depicts a rotary polishing disc in accordance with the present invention referred to by a general reference character 10. The rotary polishing disc 10 preferably includes a cylindrically-shaped hub 12 and a disc-shaped piece 14 of sheet material. As illustrated by dashed circular lines in FIG. 1A, disc-shaped pieces 14 are preferably cut, stamped, or punched from a sheet 16 of thin flexible material coated with abrasive material 18 on one or both sides in accordance with the description set forth in U.S. Pat. No. 3,014,795.

The hub 12 is formed symmetrically about a longitudinal axis 22 that extends through a hollow interior 24 of the hub 12. When assembled into the rotary polishing disc 10, the hub 12 is juxtaposed with and fixed to a surface 26 of the disc-shaped piece 14 so the longitudinal axis 22 is oriented substantially perpendicular to the surface 26. The hollow interior 24 of the hub 12 is formed with a cross-sectional shape that is adapted to receive a projecting end 32 of a mating arbor 34. A second end 36 of the arbor 34, distal from the projecting end 32, is adapted for conventional attachment to a rotary drive not illustrated in any of the FIGS. The projecting end 32 of the arbor 34 and the mating hollow interior 24 may be formed to have any desired cross-sectional shape that resists slippage between the rotating arbor 34 and the mating hub 12 received onto the projecting end 32. Such cross-sectional shapes include square, as illustrated in FIG. 1*b*, round, triangular, hexagonal, octagonal or fluted.

FIG. 1B illustrates that the hubs 12 are preferably cut, as indicated by dashed lines 42, from a length of plastic tube 44 extruded from PVC (Polyvinyl Chloride) material. However the hubs 12 can be made in other ways from PVC or from any material having suitable physical and mechanical characteristics. In fabricating the rotary polishing disc 10, one end of the hub 12 is preferably fixed to the surface 26 by a bead 52 of adhesive material that encircles the hub 12 about a juncture 54 between the hub 12 and the disc-shaped piece 14. The adhesive material, which is preferably a medical device adhesive marketed by Loctite Corporation having product no. 3341 (part no. 23792), is an ultraviolet ("UV") cured PVC bonding material. Alternatively to the use of the adhesive material, the hub 12 may be fixed to the disc-shaped piece 14 either by ultrasonic welding or by thermo-compression bonding.

The projecting end 32 of the arbor 34 is slightly oversized in comparison with the hollow interior 24 of the hub 12 to provide a tight fit therebetween. To further resist slippage between the arbor 34 and the hub 12, the arbor 34 may include barbs 62, shown with dashed lines in FIG. 1, which spear the surrounding hub 12 when the hollow interior 24 is disposed on the arbor 34. As illustrated in FIG. 1, the barbs 62 are preferably oriented to impede detachment of the hub 12 from the arbor 34. In the embodiment of the rotary polishing disc 10 depicted in FIG. 1, the projecting end 32 may enter completely into the hollow interior 24 of the hub 12 and become juxtaposed with the disc-shaped piece 14 to resist wobbling of the rotary polishing disc 10 on the rotating arbor 34.

Figure 2:
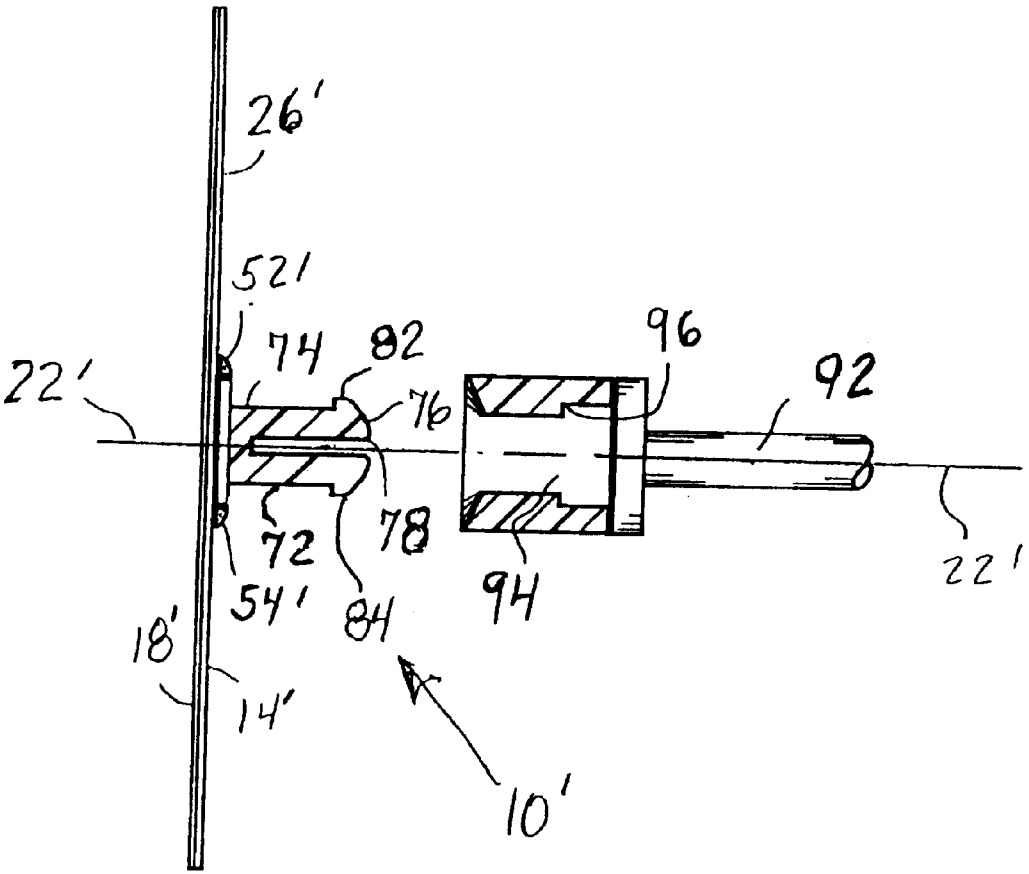
FIG. 2 is a partially-sectioned elevational view showing another embodiment of the rotary polishing disc with a disc-shaped piece of sheet material fixed to a molded hub having flexible arms with projecting tips that is aligned for interconnection with a socketed end of a mating arbor.

FIG. 2 depicts an alternative embodiment of the rotary polishing disc 10. Those elements depicted in FIG. 2 that are common to the rotary polishing disc 10 illustrated in FIG. 1 carry the same reference numeral distinguished by a prime ("') designation. The rotary polishing disc 10' depicted in FIG. 2 includes an elongated hub 72 having a mushroom-shaped first end 74. The first end 74 is juxtaposed with and fixed to the surface 26' of the disc-shaped piece 14' with the longitudinal axis 22' of the hub 72 disposed substantially perpendicular to the surface 26'. The hub 72 has a second end 76 that projects away from the disc-shaped piece 14. The second end 76 of the hub 72 is pierced by at least one slot 78 which establishes two flexible arms 82. An end of each of the flexible arms 82 furthest from the first end 74 is formed with an outwardly projecting tip 84. The flexible arms 82 can be formed to have various alternative cross-sectional shapes perpendicular to the longitudinal axis 22' including round, square, triangular, hexagonal, octagonal or fluted.

FIG. 2 also depicts an arbor 92 having a hollow socket 94 that is adapted to mate with and receive the second end 76 of the hub 72. To resist slippage between the arbor 92 and the hub 72, the socket 94 is formed with substantially the same or similar cross-sectional shape perpendicular to the longitudinal axis 22' as the flexible arms 82 of the hub 72. To create a snap lock between the arbor 92 and the hub 72, the socket 94 is formed with a groove 96 that is adapted to receive the projecting tip 84 formed at the end of each of the flexible arms 82. Slightly oversize configuration of the hub 72 with respect to the socket 94 causes the flexible arms 82 to be compressed as the second end 76 is inserted into the socket 94. Insertion of the second end 76 completely into the socket 94 permits each tip 84 to be received into the groove 96 thereby relieving the compression of the flexible arms 82. This permits the rotary polishing disc 10' to be attached or detached quickly and easily from the arbor 92 while holding the rotary polishing disc 10' securely during use.

Similar to the rotary polishing disc 10 depicted in FIG. 1, the mushroom-shaped first end 74 of the hub 72 is preferably fixed to the surface 26' by a bead 52' of adhesive material that encircles the first end 74 about a juncture 54' between the hub 72 and the disc-shaped piece 14'. Alternatively, the hub 72 may be fixed to the disc-shaped piece 14 either by ultrasonic welding or by thermo-compression bonding.

Figure 3:
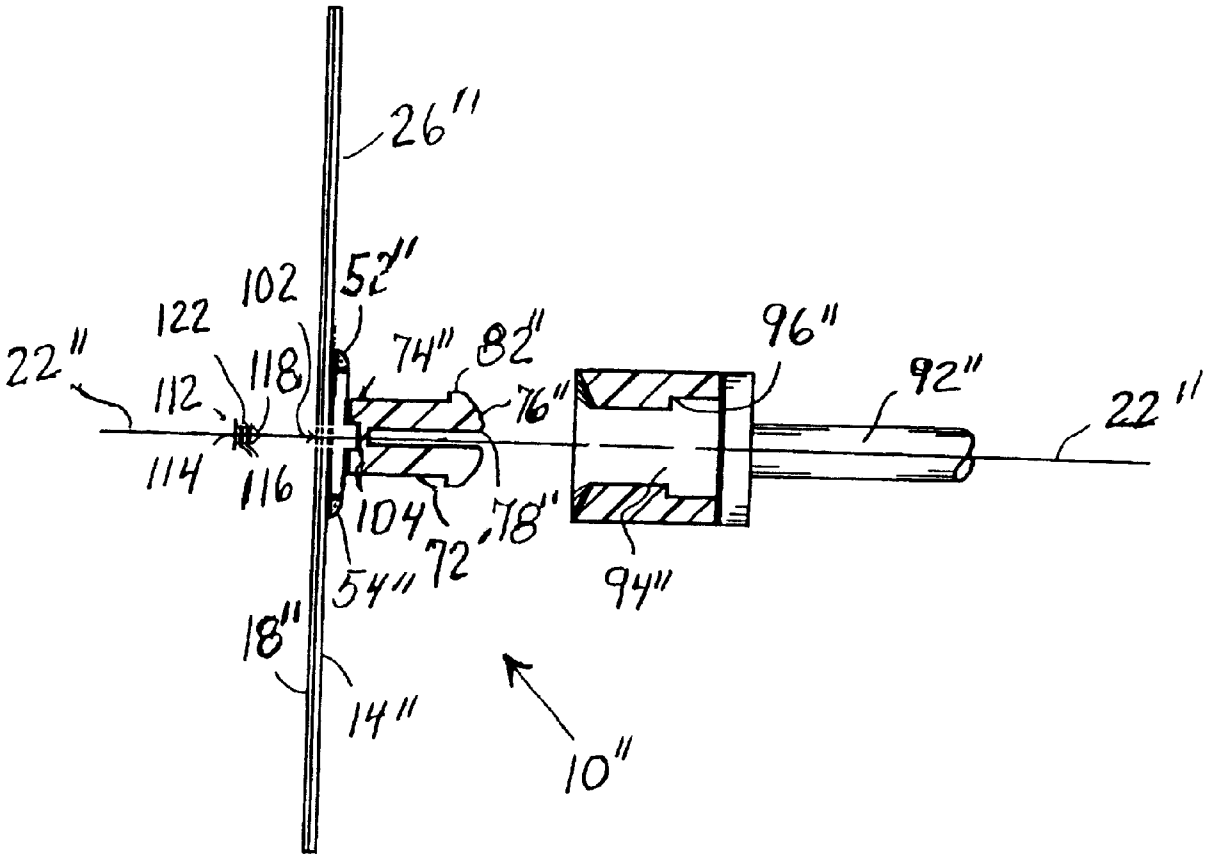
FIG. 3 is a partially-sectioned elevational view of the rotary polishing disc of FIG. 2 with a retainer plug aligned for insertion through the polishing disc into a cavity in the hub to clamp the disc-shaped piece of sheet material to hub.

FIG. 3 depicts an alternative embodiment of the rotary polishing disc 10' illustrated in FIG. 2. Those elements depicted in FIG. 3 that are common to the rotary polishing disc 10 illustrated in FIG. 1 or to the rotary polishing disc 10' illustrated in FIG. 2 carry the same reference numeral distinguished by a double prime ("") designation. The disc-shaped piece 14" of the rotary polishing disc 10" depicted in FIG. 3 is pierced by a central aperture 102 that is situated adjacent to the hub 72". The embodiment of the hub 72" illustrated in FIG. 3 has a cavity 104 formed into the hub 72" adjacent to the central aperture 102.

The rotary polishing disc 10" illustrated in FIG. 3 also includes a retainer plug 112. The retainer plug 112 includes a thin flat cap 114 or shoulder, a series of ribs 116 that encircle the retainer plug 112, and a pointed tip 118. To fix the disc-shaped piece 14" more securely to the hub 72", the pointed tip 118 is inserted through the central aperture 102 and into the cavity 104 until the flat cap 114 becomes juxtaposed with a surface of the disc-shaped piece 14" furthest from the hub 72". The ribs 116 encircling the retainer plug 112 are shaped slightly oversize with respect to the cavity 104 to establish a frictional engagement therebetween for retaining the retainer plug 112 in the cavity 104. Before the pointed tip 118 is inserted into the cavity 104, an adhesive material 112 may be coated onto the retainer plug 112 to add an adhesive bond between the retainer plug 112 and the hub 72".

Figure 4:
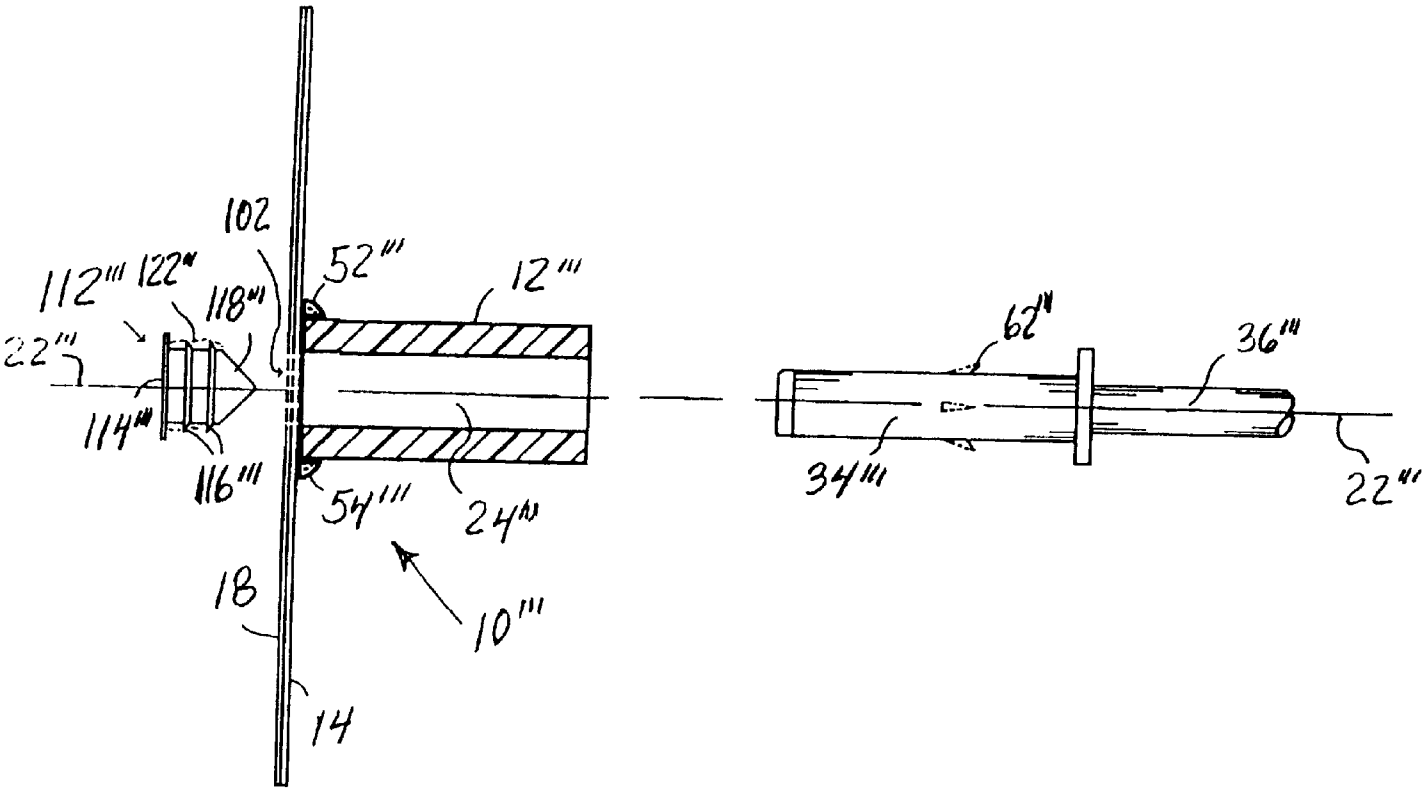
FIG. 4 is a partially-sectioned elevational view of the rotary polishing disc of FIG. 1 with a retainer plug aligned for insertion through the polishing disc into a hollow interior of the hub to clamp the disc-shaped piece of sheet material to hub.

FIG. 4 depicts an alternative embodiment of the rotary polishing disc 10 illustrated in FIG. 1. Those elements depicted in FIG. 4 that are common to the rotary polishing disc 10 illustrated in FIG. 1 or to the rotary polishing disc 10" illustrated in FIG. 3 carry the same reference numeral distinguished by a triple prime ("""") designation. Similar to the disc-shaped piece 14" of the rotary polishing disc 10" depicted in FIG. 3, the disc-shaped piece 14''' depicted in FIG. 4 is pierced by a central aperture 102''' adjacent to the hub 12'''. To fix the disc-shaped piece 14''' more securely to the hub 12''', the pointed tip 118''' of the retainer plug 112''' depicted in FIG. 4 is inserted through the central aperture 102"40 and into the hollow interior 24''' of the hub 12''' until the flat cap 114''' becomes juxtaposed with a surface of the disc-shaped piece 14''' furthest from the hub 12'''. The ribs 116''' encircling the retainer plug 112''' are shaped slightly oversize with respect to the hollow interior 24''' to establish a frictional engagement therebetween for retaining the retainer plug 112''' in the hollow interior 24'''. Before the pointed tip 118''' is inserted into the cavity 104''', an adhesive material 112''' may be coated onto the retainer plug 112''' to add an adhesive bond between the retainer plug 112''' and the hub 12'''.

Although the present invention has been described in terms of the presently preferred embodiment, it is to be understood that such disclosure is purely illustrative and is not to be interpreted as limiting. consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A rotary polishing disc adapted for attachment a socketed end of a rotatable arbor, the rotary polishing disc comprising:

a. a disc-shaped piece of sheet material:
   i. having an abrasive material on at least one surface thereof; and
   ii. being pierced by an aperture;

b. an elongated hub having:
   i. a first end that is:
      1) juxtaposed with and fixed to one surface of said disc-shaped piece of sheet material so a longitudinal axis of said hub is oriented substantially perpendicular to the surface of said disc-shaped piece of sheet material that is juxtaposed with said hub; and
      2) having a cavity formed thereinto adjacent to said aperture that pierces said disc-shaped piece of sheet material;
   ii. a second end that projects away from said disc-shaped piece of sheet material, the second end of said hub being shaped to mate with and to engage an interior surface of the socketed end of the rotatable arbor; and c. a retainer plug having a flat cap formed at an end thereof, another end of said retainer plug distal from the flat cap being inserted through the aperture that pierces said disc-shaped piece of sheet material and into the cavity formed into the first end of said hub so the flat cap of said retainer plug becomes juxtaposed with a surface of said disc-shaped piece of sheet material that is furthest from said hub, the cavity and the end of said retainer plug inserted thereinto being shaped to establish a frictional engagement therebetween.

2. The rotary polishing disc of claim 1 wherein said hub is fixed to said disc-shaped piece of sheet material by adhesive material disposed about a juncture between said hub and said disc-shaped piece of sheet material.

3. The rotary polishing disc of claim 1 wherein said hub is fixed to said disc-shaped piece of sheet material by an ultrasonic weld between said hub and the surface of said disc-shaped piece of sheet material juxtaposed with said hub.

4. The rotary polishing disc of claim 1 wherein said hub is fixed to said disc-shaped piece of sheet material by a thermo-compression bond between said hub and the surface of said disc-shaped piece of sheet material juxtaposed with said hub.

5. A rotary polishing disc adapted for attachment to a socketed end of a rotatable arbor, the rotary polishing disc comprising:

a disc-shaped piece of sheet material having an abrasive material on at least one surface thereof; and an elongated hub having a first end that is juxtaposed with and fixed to one surface of said disc-shaped piece of sheet material so a longitudinal axis of said hub is oriented substantially perpendicular to the surface of said disc-shaped piece of sheet material that is juxtaposed with said hub, said hub having a second end that:

a. projects away from said disc-shaped piece of sheet material;

b. is shaped to mate with and to engage an interior surface of the socketed end of the rotatable arbor; and c. is pierced by a slot to establish at least one flexible arm that has an outwardly projecting tip at the end of the flexible arm furthest from said disc-shaped piece of sheet material, the flexible arm and tip being shaped to mate with and to engage an interior surface of the socketed end of the rotatable arbor.

6. The rotary polishing disc of claim 5 wherein:

said disc-shaped piece of sheet material is pierced by an aperture that is situated adjacent to said hub; and the first end of said hub that is juxtaposed with said disc-shaped piece of sheet material has a cavity formed thereinto adjacent to said aperture;

said rotary polishing disc further comprising a retainer plug having a flat cap formed at an end thereof, another end of said retainer plug distal from the flat cap being inserted through the aperture that pierces said disc-shaped piece of sheet material and into the cavity formed into the first end of said hub so the flat cap of said retainer plug becomes juxtaposed with a surface of said disc-shaped piece of sheet material that is furthest from said hub, the cavity and the end of said retainer plug inserted thereinto being shaped to establish a frictional engagement therebetween.

7. The rotary polishing disc of claim 5 wherein said hub is fixed to said disc-shaped piece of sheet material by adhesive material disposed about a juncture between said hub and said disc-shaped piece of sheet material.

8. The rotary polishing disc of claim 5 wherein said hub is fixed to said disc-shaped piece of sheet material by an ultrasonic weld between said hub and the surface of said disc-shaped piece of sheet material juxtaposed with said hub.

9.The rotary polishing disc of claim 5 wherein said hub is fixed to said disc-shaped piece of sheet material by a thermo-compression bond between said hub and the surface of said disc-shaped piece of sheet material juxtaposed with said hub.

* * * * *